US007942605B2

(12) United States Patent
Hall et al.

(10) Patent No.: US 7,942,605 B2
(45) Date of Patent: May 17, 2011

(54) MILLING DRUM

(76) Inventors: David R. Hall, Provo, UT (US); David Wahlquist, Spanish Fork, UT (US); Neil Cannon, Provo, UT (US); Thomas Morris, Spanish Fork, UT (US)

( * ) Notice: Subject to any disclaimer, the term of this patent is extended or adjusted under 35 U.S.C. 154(b) by 705 days.

(21) Appl. No.: 11/844,466

(22) Filed: Aug. 24, 2007

(65) Prior Publication Data

US 2009/0052987 A1 Feb. 26, 2009

(51) Int. Cl.
*E01C 23/12* (2006.01)

(52) U.S. Cl. ..... 404/94; 299/39.2; 299/56; 299/65

(58) Field of Classification Search ..... 299/39.2, 299/39.4, 56, 57, 64, 65; 404/90, 94, 129
See application file for complete search history.

(56) References Cited

U.S. PATENT DOCUMENTS

| | | | | | |
|---|---|---|---|---|---|
| 3,982,688 | A * | 9/1976 | Taylor | 299/64 |
| 4,041,623 | A * | 8/1977 | Miller et al. | 37/382 |
| 4,139,318 | A | 2/1979 | Jakob | |
| 4,186,968 | A * | 2/1980 | Barton | 299/39.2 |
| 4,193,636 | A * | 3/1980 | Jakob | 299/39.2 |
| 4,793,730 | A | 12/1988 | Butch | |
| 4,827,559 | A | 5/1989 | Norland | |
| 5,078,540 | A | 1/1992 | Jakob | |
| 5,315,770 | A * | 5/1994 | Campbell | 37/96 |
| 5,441,361 | A * | 8/1995 | Campbell | 404/90 |
| 5,505,598 | A | 4/1996 | Murray | |
| 5,575,538 | A * | 11/1996 | Gilbert et al. | 299/39.2 |
| 5,794,854 | A | 8/1998 | Yie | |
| 6,149,342 | A * | 11/2000 | Phillips | 404/90 |
| 6,318,351 | B1 * | 11/2001 | Baratta | 125/12 |
| 6,457,779 | B1 * | 10/2002 | Busley et al. | 299/39.2 |
| 6,733,086 | B1 * | 5/2004 | McSharry et al. | 299/64 |
| 7,175,364 | B2 * | 2/2007 | Gaertner et al. | 404/76 |
| 7,219,964 | B2 * | 5/2007 | Berning et al. | 299/64 |
| 7,422,390 | B2 * | 9/2008 | Gaertner et al. | 404/76 |
| 7,458,645 | B2 * | 12/2008 | Hall et al. | 299/39.2 |
| 7,507,053 | B2 * | 3/2009 | Hall | 404/92 |
| 2002/0017817 | A1 * | 2/2002 | Nakayama | 299/39.3 |
| 2008/0267706 | A1 * | 10/2008 | Hall et al. | 404/90 |

* cited by examiner

*Primary Examiner* — Gary S Hartmann
(74) *Attorney, Agent, or Firm* — Tyson J. Wilde; Philip W. Townsend, III

(57) ABSTRACT

In one aspect of the invention a system for removing a layer of a paved surface comprising a vehicle is adapted to traverse a paved surface in a selected direction. The vehicle has a milling drum with an axle substantially parallel and connected to the vehicle within a milling chamber. The drum is adapted to rotate around the axle between the paved surface and the vehicle. A conveyor belt is attached to a forward end of the vehicle and comprises a portion proximate an opening of the milling chamber. The belt is adapted to carry loose aggregate from the milling drum away from the paved surface. At least one nozzle is disposed on an underside of the vehicle and is in communication with a reservoir through a pathway. The at least one nozzle is adapted to direct the loose aggregate towards the portion of the conveyor belt.

20 Claims, 10 Drawing Sheets

MILLING DRUM

BACKGROUND OF THE INVENTION

The present invention relates to milling machines that are used in road surface repairs. Milling machines are typically utilized to remove a layer or layers of old or defective road surface in preparation for resurfacing. Resurfacing an existing road surface with such defects may result in a perpetuation of prior existing conditions, especially if the road surface is exposed to heavy and/or continuous traffic which often requires the road to be resurfaced again within a short period of time. Milling may also provide a renewable source of aggregate such as recycled asphalt that may be used to resurface milled surfaces.

Typically the milling machines direct milled road fragments towards a conveyer which takes the fragments off the road, however, a significant amount of debris, aggregate, and fragments remain on the milled surface. When using asphalt or other pavement material to resurface a road the milled surface must be substantially clean of any residue material before a new layer can be deposited. Failure to clear the milled surface of such material may result in poor bonding between the new asphalt and the milled surface. Typically a sweeper will come along after the milling machine to remove of the debris, but often this is inefficient and uneconomic.

U.S. Pat. No. 4,139,318 by Jakob et al., which is herein incorporated by reference for all that it contains, discloses a method and apparatus for planning a paved roadway wherein a main frame is drivingly supported by track assemblies and a planer assembly is disposed in cutting engagement with a top portion of the pave roadway to produce a new roadway surface.

U.S. Pat. No. 4,793,730 by Butch, which is herein incorporated by reference for all that it contains, discloses a method and apparatus for renewing the surface of asphaltic paving at low cost and for immediate reuse.

U.S. Pat. No. 5,505,598 by Murray, which is herein incorporated by reference for all that it contains, discloses a modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine.

U.S. Pat. No. 6,733,086 by McSharry et al., which is herein incorporated by reference for all that it contains, discloses a vacuum system mounted on a portable milling machine for extracting material cut by the milling drum of the machine from the surface of a roadway.

BRIEF SUMMARY OF THE INVENTION

In one aspect of the invention a system for removing a layer of a paved surface comprising a vehicle is adapted to traverse a paved surface in a selected direction. The vehicle has a milling drum with an axle substantially parallel and connected to the vehicle within a milling chamber. The drum is adapted to rotate around the axle between the paved surface and the vehicle. A conveyor belt is attached to a forward end of the vehicle and comprises a portion proximate an opening of the milling chamber. The belt is adapted to carry loose aggregate from the milling drum away from the paved surface. At least one nozzle is disposed on an underside of the vehicle and is in communication with a reservoir through a pathway. The at least one nozzle is adapted to direct the loose aggregate towards the portion of the conveyor belt.

The nozzle may be positioned on the underside of the vehicle near the upper front quadrant of the drum and project fluid at 1,000 to 10,000 PSI toward loose aggregate. The nozzle may also project 10 to 50 gal/min of fluid toward the loose aggregate. The nozzle may be a fluidic nozzle that projects fluid in the direction opposing the rotation of the drum. The nozzle may be pointed in the direction of the conveyor belt. The nozzle may be able to swivel in multiple directions and may be in communication with a power source. The nozzle may also be in communication with a reservoir through a pathway that may comprise fluid, air, gas, water, liquid, carbon dioxide, or a combination thereof The nozzle may extend to at least one pick disposed on the drum and may be adapted to remove loose aggregate. The nozzle may also comprise an arm that extends from the nozzle to the at least one pick on the drum and may be adapted to loosen aggregate disposed on the at least one pick.

The drum within the milling chamber may comprise a fluid, gas, water, liquid, carbon dioxide, or a combination thereof to loosen aggregate on the surface of the drum. The fluid within the drum may also lubricate the pick and surface of the drum. The drum may also comprise at least one hole with which at least one retractable protrusion proceeds in and out of the drum to loosen aggregate on the surface of the drum.

The underside of the vehicle may comprise an arm extending to the pick disposed on the drum and may be adapted to dislodge loose aggregate from the pick. A boundary of the milling chamber may comprise a plurality of picks offset relative to one another. A boundary of the milling chamber may also comprise a brush with the bristles of said brush in contact with the picks disposed on the drum. A boundary of the milling chamber may comprise at least one retractable protrusion adapted to loosen aggregate on the drum. The retractable protrusion may extend to and from the drum.

The vehicle may comprise conveyor belt. The conveyor belt may comprise a vacuum device adapted to remove loose aggregate from the drum and place the loose aggregate onto the conveyor belt.

In another aspect of the invention, a method comprising the steps of providing a vehicle adapted to traverse a paved surface in a selected direction. Providing a milling drum with an axle connected to the vehicle, the drum being adapted to rotate around the axle. Also, providing at least one nozzle in communication with a reservoir through a pathway and being positioned on the underside of the vehicle and near the top left quadrant of the drum opposite the surface. Rotating the drum against a paved surface such that a layer of the paved surface is loosened. Then, cleaning an exposed layer of the paved surface by directing a portion of the loosened aggregate in a generally forward direction by ejecting a fluid out of the at least one nozzle onto the conveyor belt.

DETAILED DESCRIPTION OF THE INVENTION AND THE PREFERRED EMBODIMENT

Figure 1:
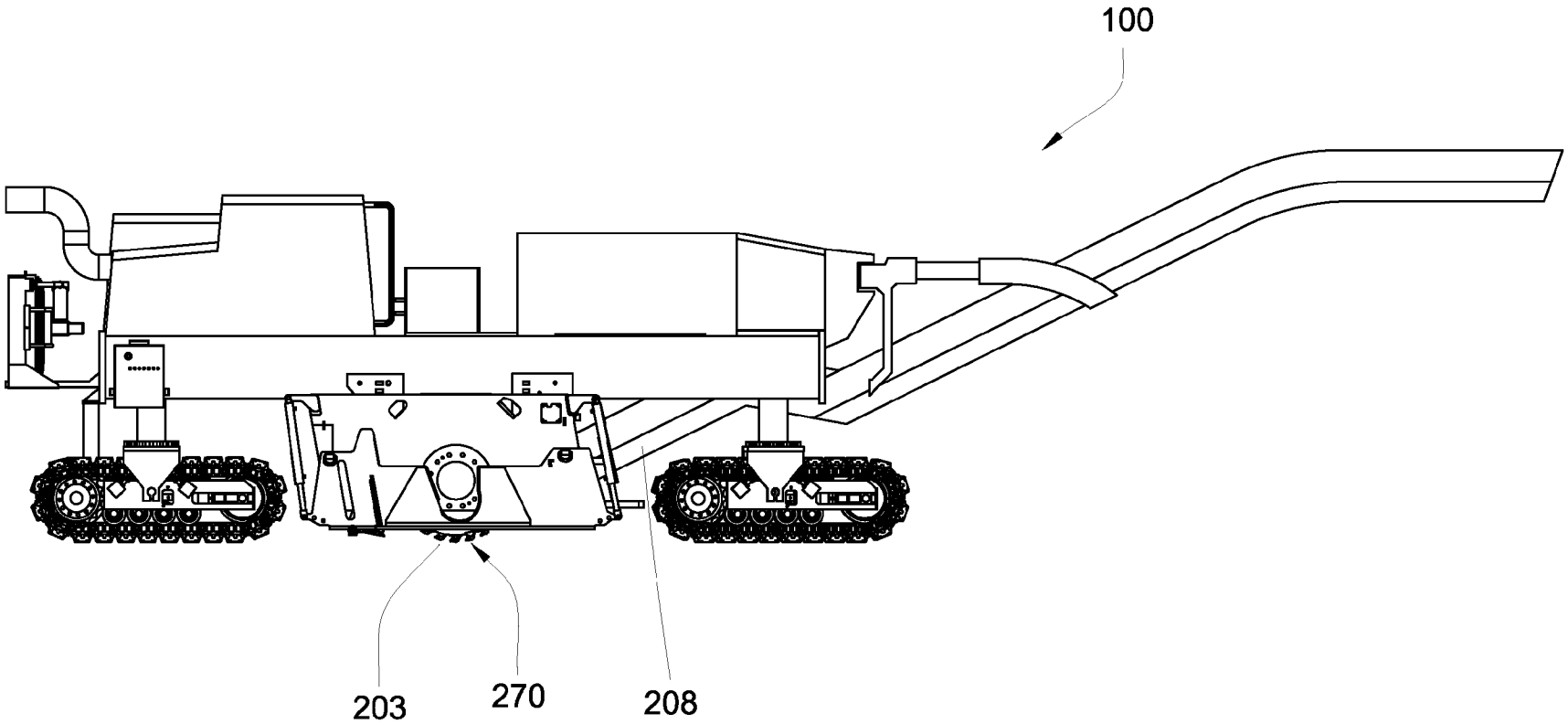
FIG. 1 is an orthogonal diagram of a milling machine.

FIG. 1 depicts a milling machine 100 which may be used to remove asphalt from road surfaces. A milling drum 203 is attached to the underside of the frame of the milling machine 100. The milling drum 203 may comprise at least one pick 270 adapted to engage a surface. A conveyer 208 is adapted to take the millings off the road. Typically the millings are loaded into a bed of a truck (not shown) where the millings may be hauled away.

Figure 2:
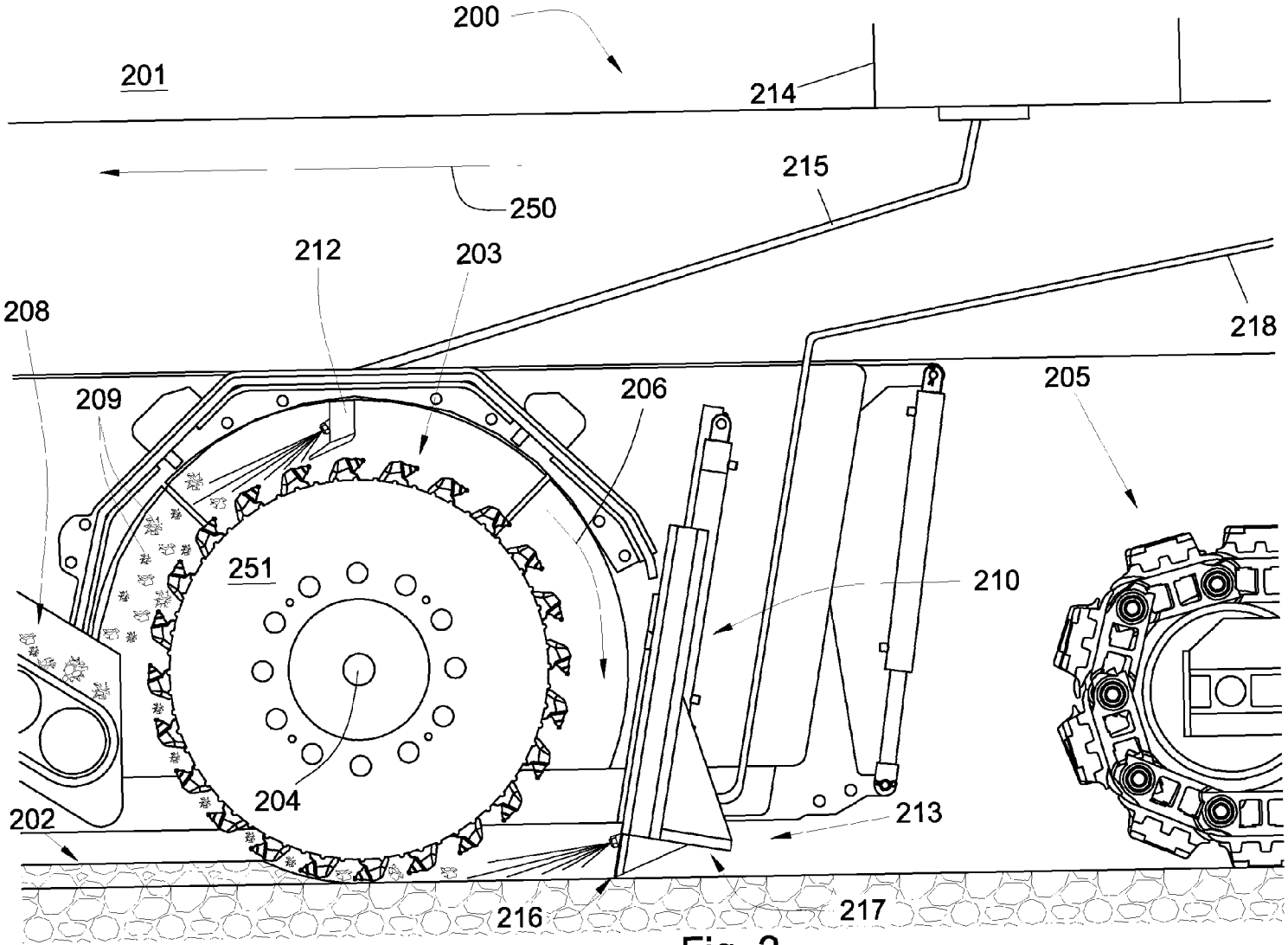
FIG. 2 is a cross sectional diagram of a milling drum.

FIG. 2 is an cross sectional diagram of an embodiment of the current invention, specifically a system 200 for removing a layer of paved surface. The system 200 may comprise a vehicle 201 adapted for road milling and traversing a paved surface 202 in a selected direction depicted by arrow 250 with a milling drum 203 comprising an axle 204 connected to the vehicle 201. In the current embodiment the vehicle 201 comprises tracks 205, but in other embodiments wheels may be utilized. The milling drum 203 may also be adapted to rotate around the axle 204 in the selected direction. In some embodiments the milling drum 203 may be rotated in a clockwise direction, depicted by arrow 206, by a means which may include an internal combustion engine (not shown). A conveyer belt 208 may be positioned adjacent the milling drum 203 and adapted to remove a portion of the aggregate 209. The loose aggregate 209 may then be deposited into a collecting vehicle (not shown) that may follow in front, rear or side of the milling vehicle 201.

A moldboard 210 may be connected to the vehicle 201 which is positioned rearward of the milling drum 203. The moldboard 210 may push loose aggregate or debris along with the milling machine. An end 213 of the moldboard may comprise a leading edge 216 that is adapted to engage the loose aggregate and/or debris. The end 213 may also comprise a rear portion 217 disposed generally rearward the leading edge. In some embodiment, the moldboard may comprises a plurality of nozzles which are adapted to prevent debris, dust, loose aggregate or combinations thereof from escaping underneath the moldboard and direct it back to the milling drum such that the milling drum may direct it to the conveyor belt. Such a system is disclosed in U.S. patent application Ser. No. 11/566,151, which is herein incorporated by reference for all that is contains. Fluid ejected from these nozzles may be carried by fluid line 218 which may connect the nozzles to a fluid reservoir A plurality of nozzles 212 may be disposed on the underside of the vehicle 201 and proximate the upper front quadrant 251 of the drum 203. The plurality of nozzles 212 may be in communication with a fluid reservoir 214 through a fluid pathway 215. The fluid may comprise hot fluid, air, gas, liquid, carbon dioxide steam, cold fluid, water, polymers, synthetic clay, surfactants, binding agents, or combinations thereof depending on the type of application in which the system 200 is being engaged. In some embodiments the kinetic energy resulting from the fluid being ejected from the nozzles 212 may help to push aggregate towards the conveyor belt 208 and prevent any loose aggregate 209 from traveling over the moldboard. In other embodiments the chemical composition of the fluid may be used to provide a substantially cleaner milled surface 211 for resurfacing. In some embodiments the fluid from the nozzles 212 may also provide a means of substantially reducing dust particles.

Figure 3:
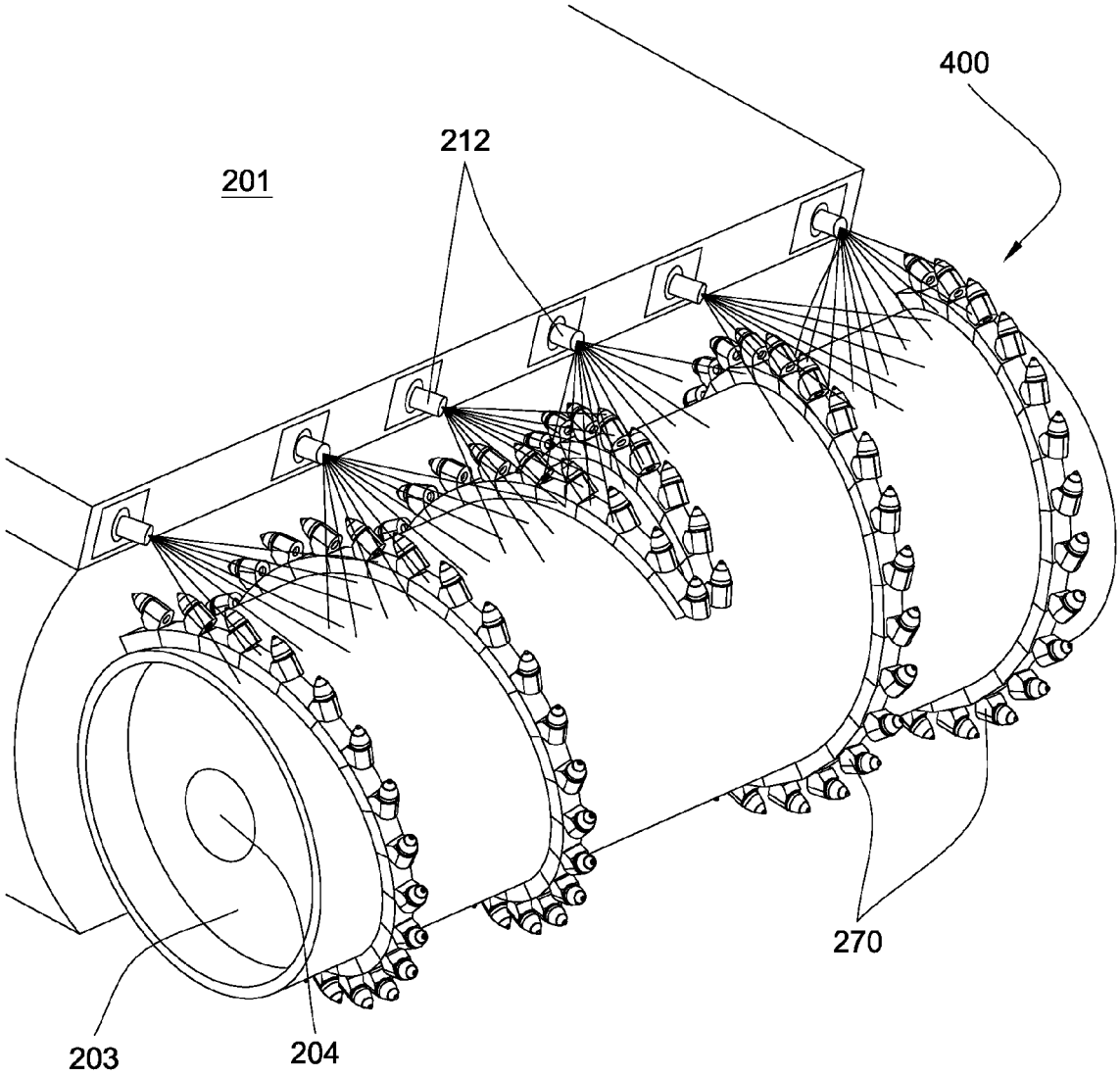
FIG. 3 is a perspective cutaway diagram of a milling drum.

FIG. 3 is a perspective cutaway of a vehicle 201 adapted for road milling. The vehicle 201 may comprise a drum 203 that is disposed around an axle 204. The drum 203 may comprise a plurality of picks 270 disposed on its surface. The picks 270 may be disposed in a helical arrangement 400 on the surface of the drum 203 which may aid in funneling loose aggregate to the conveyor belt. The vehicle 201 may also comprise a plurality of nozzles 212. The nozzles 212 may be offset relative to one another. This may help in covering the entire portion of the drum 203 that passes by the said nozzles 212 with the fluid. The nozzles 212 may project the fluid in a direction opposing the rotation of the drum 203.

Figure 4:
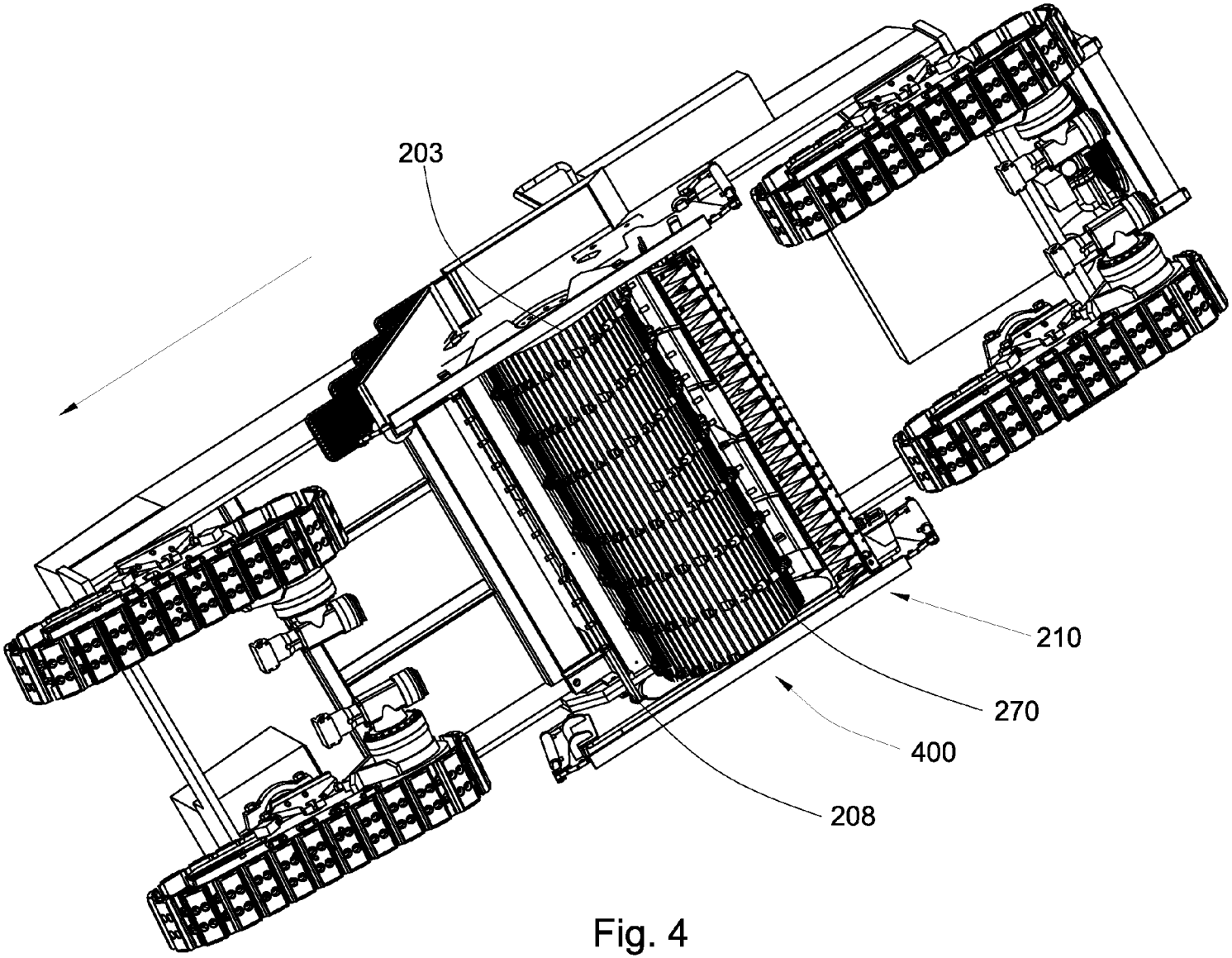
FIG. 4 is a perspective diagram of the underside of a milling machine.

FIG. 4 is a diagram of another embodiment of the system 200 wherein the milling drum 203 may comprise a plurality picks 270 in a helical arrangement 400 adapted to degrade the paved surface and direct aggregate laterally towards the center of the milling drum 203. The aggregate may then be subsequently directed towards a conveyer belt 208 for removal. In this embodiment the helical arrangement 400 may be utilized to contain the loose aggregate or debris and help to prevent the material from being diffused on either side of the milling drum 203. The plurality of picks 270 helical arranged around the drum 203 may be used to remove the majority of loose aggregate. The moldboard 210 may be positioned behind the drum 203 and may aid in the removal of the loose aggregate.

Figure 5:
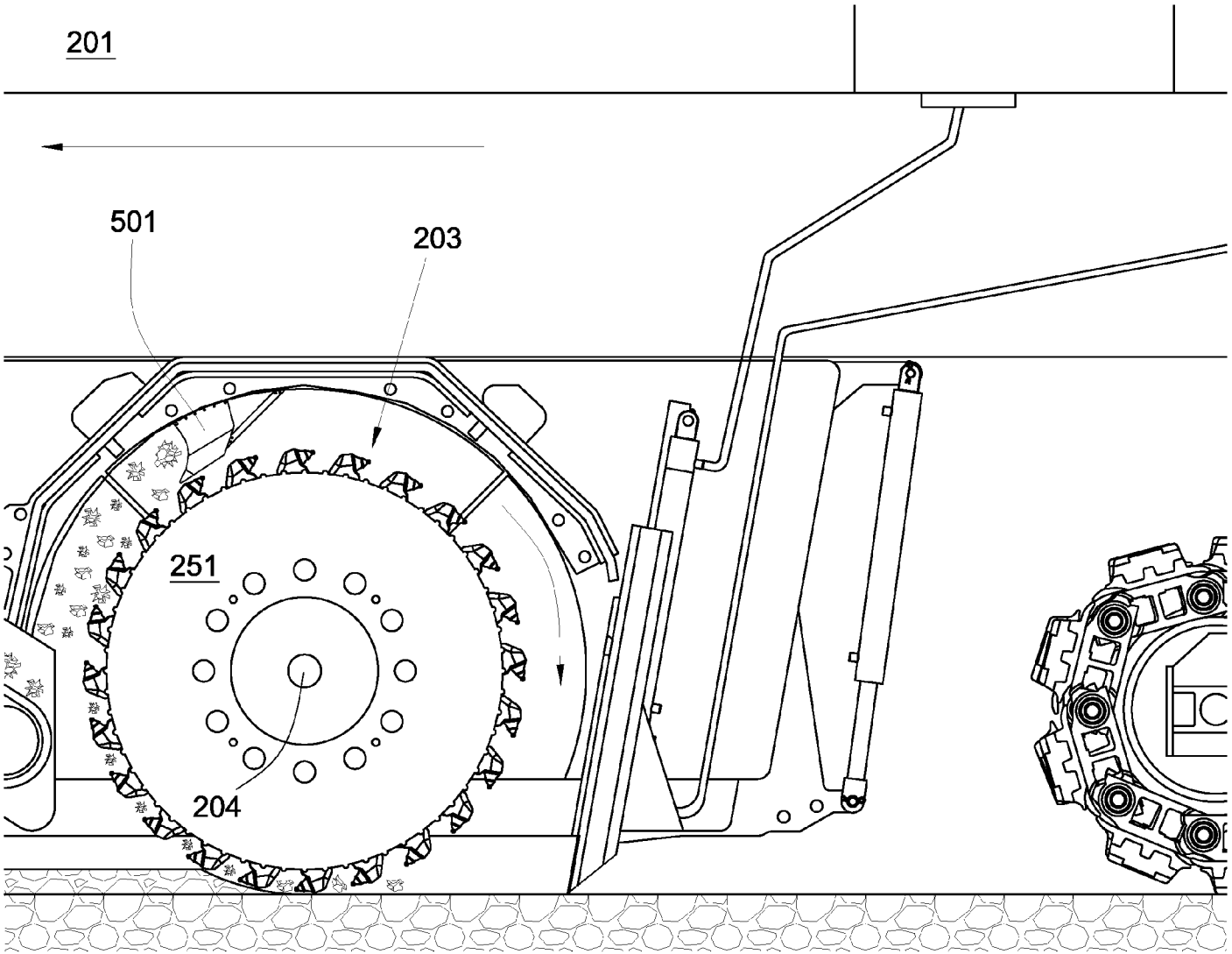
FIG. 5 is a cross sectional diagram of a milling drum.

FIG. 5 is an diagram of a vehicle 201 adapted for road milling. An arm 501 may be disposed on the underside of the vehicle 201 near the upper front quadrant 251 of the drum 203. The arm 501 may extend to at least pick 270 disposed on the drum 203. The arm 501 may also run along the entire width of the underside of the vehicle 201. The arm 501 may be adapted to dislodge loose aggregate which extends beyond the picks 270.

Figure 6:
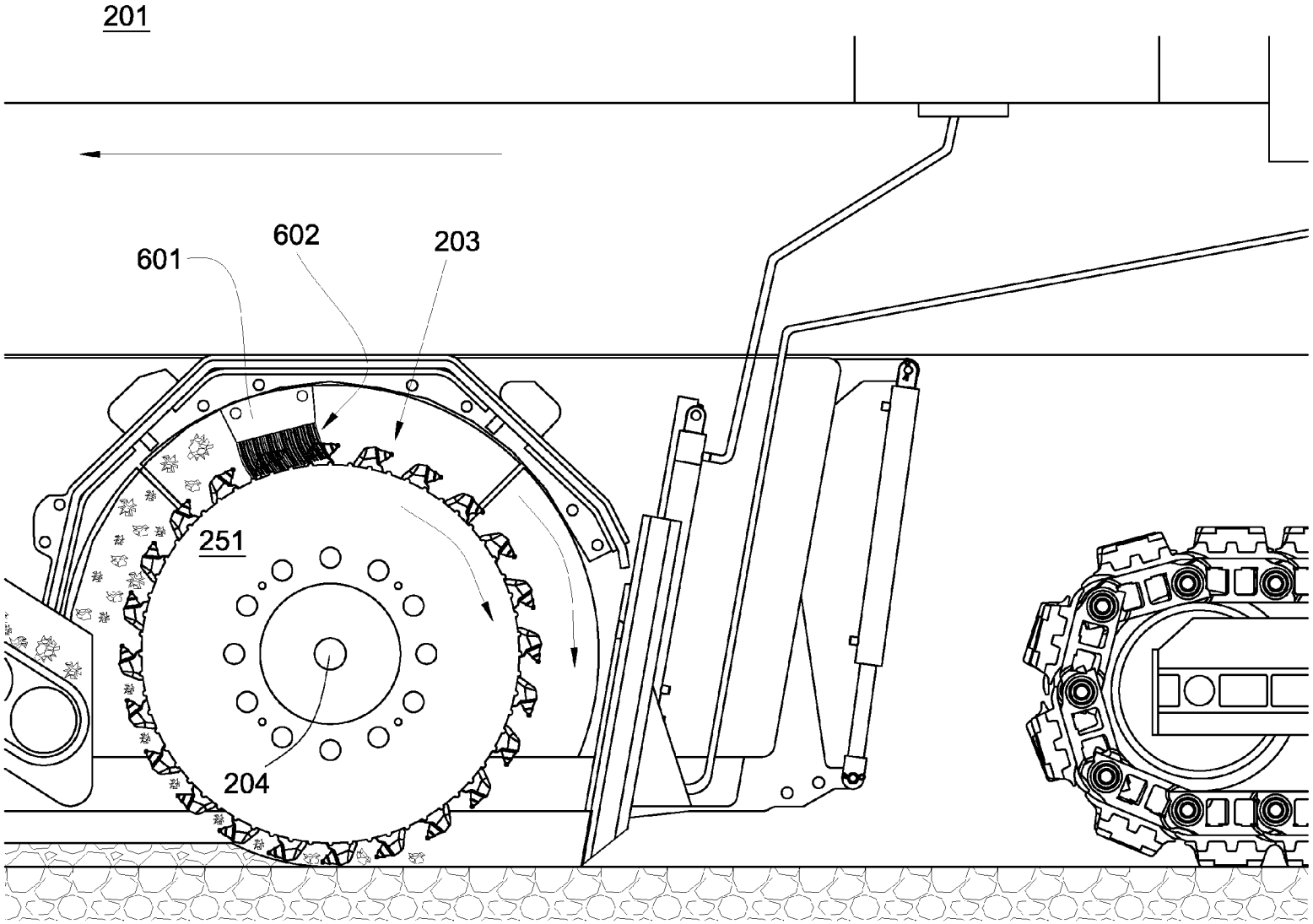
FIG. 6 is a cross sectional diagram of a milling drum.

FIG. 6 is an orthogonal diagram of a vehicle 201 adapted for road milling. The underside of the vehicle 201 may comprise a brush 601 with bristle 602. The brush 601 may be disposed on the underside of the vehicle 201 near the upper front quadrant 251 of the drum 203. The bristle 602 may extend to or past the picks 270 to the surface of the drum 203. The bristle 602 may help remove loose aggregate on the drum 203 during the milling process.

Figure 7:
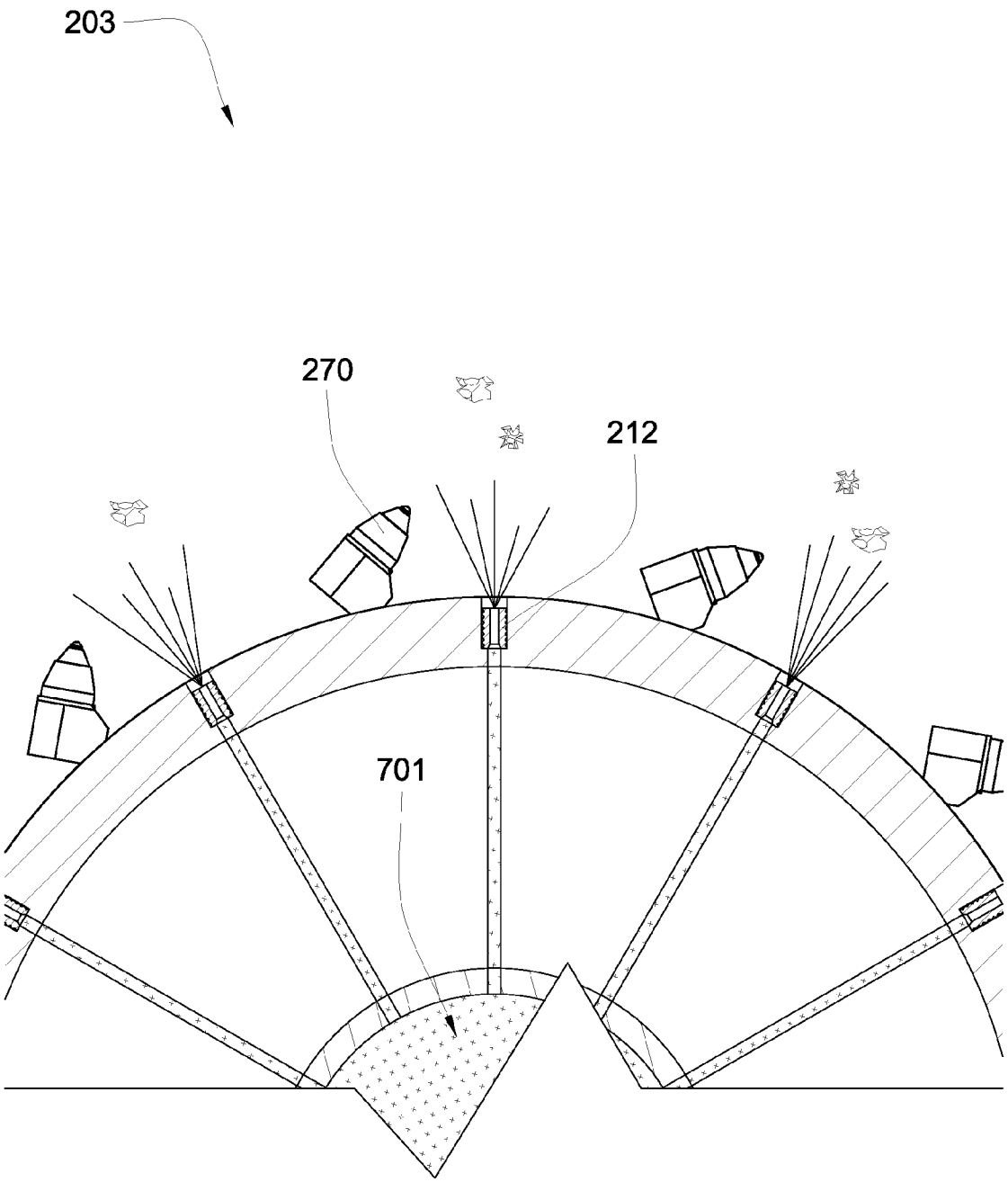
FIG. 7 is a cross-sectional diagram of milling drum.

FIG. 7 is a cross-sectional diagram of a drum 203. The drum 203 may comprise a plurality of picks 270 radially disposed around it. Intermediate the picks 270 may be nozzles 212 adapted to allow air, fluid, gas, carbon dioxide, or a combination thereof to pass through. During the milling process loose aggregate may become lodged onto the surface of the drum 203. The nozzles 212 intermediate the picks 270 may help in removing loose aggregate from the surface of the drum 203.

Figure 8:
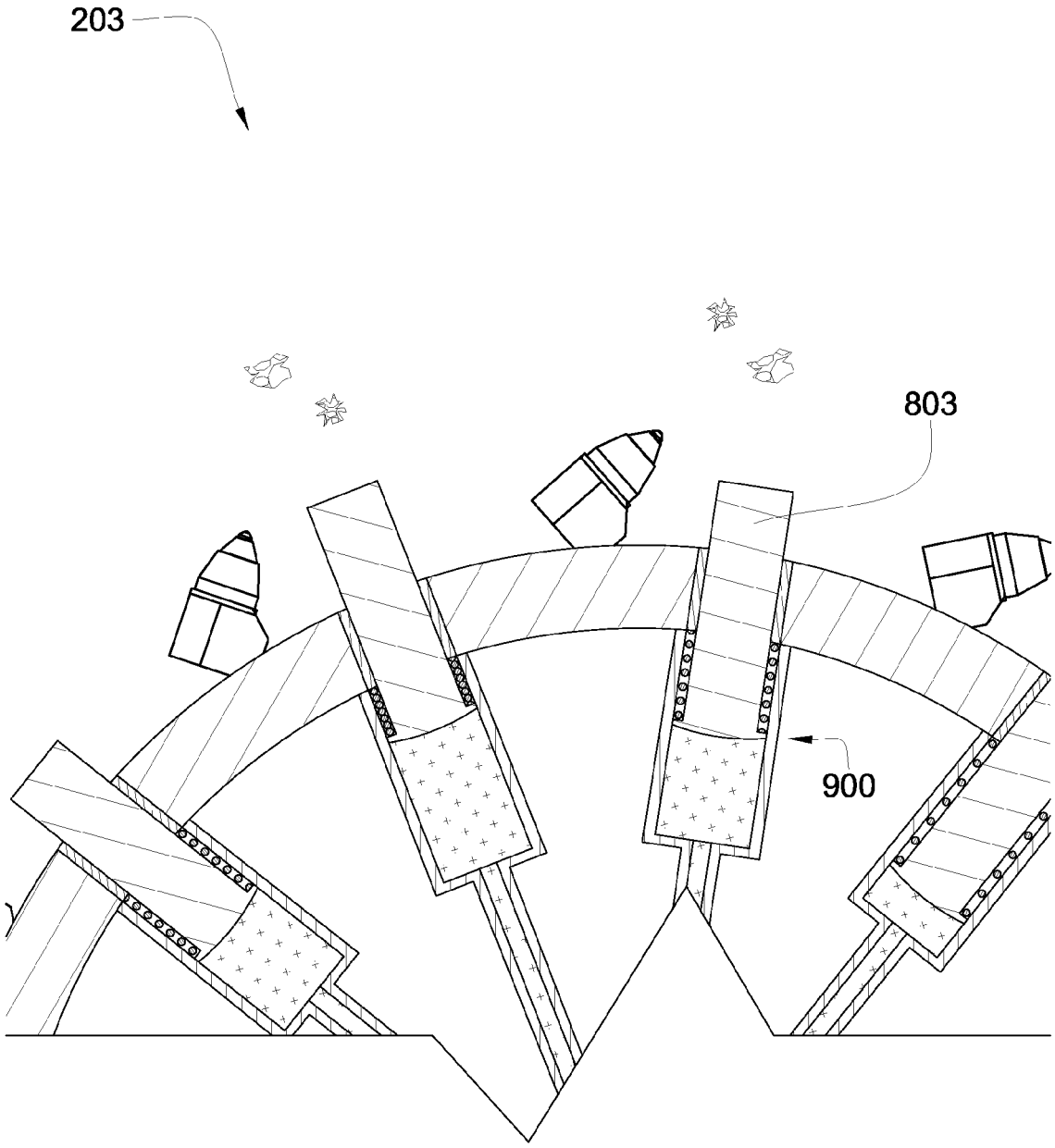
FIG. 8 is a cross-sectional diagram of a milling drum.

FIG. 8 is a cross-sectional diagram of a drum 203. The surface of the drum 203 may comprise a plurality of picks 270. Intermediate the plurality of picks may be retractable protrusions 803. The retractable protrusions may comprise a hydraulic system 900 that may control the mobility of the retractable protrusions 803. The retractable protrusions 803 may be in communication with an electrical power source (not shown).

Figure 9:
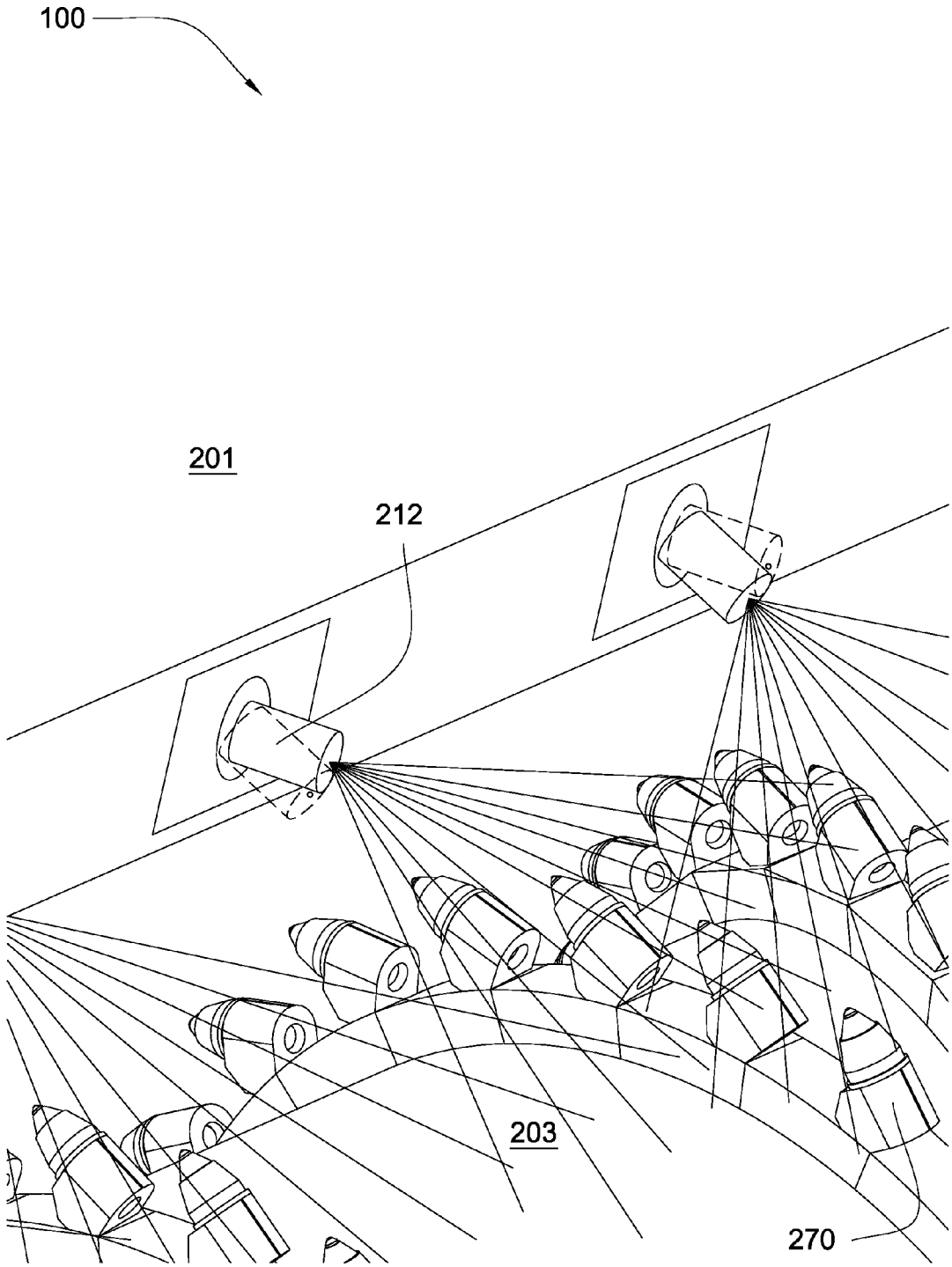
FIG. 9 is a perspective diagram of a milling drum.

FIG. 9 is a perspective diagram of the underside of a milling machine 100. The milling machine 100 may comprise a drum 203. The drum 203 may comprise a plurality of picks 270. Disposed on the underside of the milling machine 100 may be a plurality of nozzles 212. The nozzles 212 may be able to swivel, vibrate, oscillate, shake, or other move such as shown in FIG. 9, and may be in communication with a power source (not shown). The nozzles 212 may be a divergent nozzle, a convergent nozzle, an air-aspirating nozzle, a swirl nozzle, vortex nozzle, fluidic nozzle, or a combination thereof.

Figure 10:
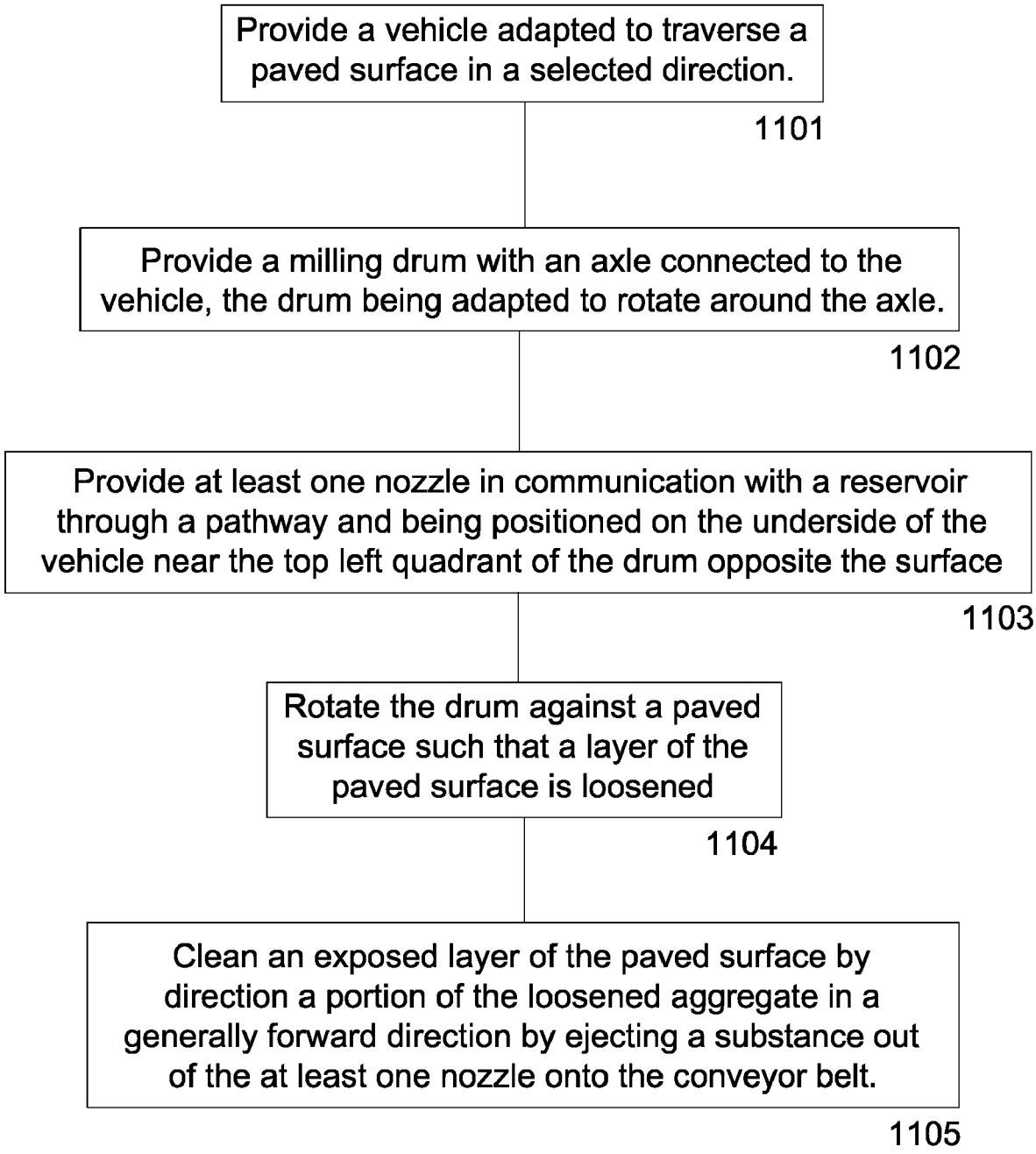
FIG. 10 is a flowchart illustrating an embodiment of a method for removing a layer of pavement

FIG. 10 is a flowchart illustrating an embodiment of a method for removing a layer of pavement. The method comprises a step of providing a vehicle adapted to traverse a paved surface in a selected direction The method further comprises a step providing a milling drum with an axle connected to the vehicle, the drum being adapted to rotate around the axle. The method further comprises a step of providing at least one nozzle in communication with a reservoir through a pathway and being positioned on the underside of the vehicle and near the top left quadrant of the drum opposite the surface. The method further comprises a step of rotating the drum against a paved surface such that a layer of the paved surface is loosened. The method further comprises a step for cleaning an exposed layer of the paved surface by directing a portion of the loosened aggregate in a generally forward direction by ejecting a fluid out of the at least one nozzle onto the conveyor belt.

Whereas the present invention has been described in particular relation to the drawings attached hereto, it should be understood that other and further modifications apart from those shown or suggested herein, may be made within the scope and spirit of the present invention.

What is claimed is:

1. A system for removing a layer of a paved surface, comprising:

a vehicle adapted to traverse a paved surface in a selected direction;

a milling drum with an axle substantially parallel and connected to the vehicle within a milling chamber and the drum being adapted to rotate around the axle between the paved surface and the vehicle, the milling drum comprising at least one pick;

a conveyor belt attached to a forward end of the vehicle and comprising a portion proximate an opening of the milling chamber, the belt being adapted to carry loose aggregate from the milling drum away from the paved surface;

at least one nozzle disposed on an underside of the vehicle and in communication with a reservoir through a pathway;

the at least one nozzle being adapted to direct the loose aggregate towards the portion of the conveyor belt.

2. The system of claim 1, wherein the at least one nozzle projects fluid at 1,000-10,000 PSI toward the loose aggregate.

3. The system of claim 1, wherein the at least one nozzle is positioned on the underside of the vehicle near the upper front quadrant of the drum.

4. The system of claim 1, wherein the at least one nozzle is a fluidic nozzle.

5. The system of claim 1, wherein the at least one nozzle is pointed in the direction of the conveyor belt.

6. The system of claim 1, wherein the at least one nozzle swivels.

7. The system of claim 1, wherein the at least one nozzle is in communication with an electric power source.

8. The system of claim 1, wherein the at least one nozzle projects fluid in a direction opposing the rotation of the drum.

9. The system of claim 1, wherein the nozzles project 10 to 50 gal/min of fluid toward loose aggregate.

10. The system of claim 1, wherein the at least one nozzle extends to the at least one pick disposed on the drum and is adapted to remove loose aggregate.

11. The system of claim 1, wherein the at least one nozzle comprises an arm that extends from the nozzle to the at least one pick disposed on the drum and is adapted to loosen aggregate disposed on the at least one pick.

12. The system of claim 1, wherein the drum comprises a fluid, gas, water, liquid, carbon dioxide, or a combination thereof adapted to loosen aggregate on the surface of the drum.

13. The system of claim 1, wherein the drum comprises at least one hole with which at least one retractable protrusion proceeds in and out of the drum to loosen aggregate on the surface of the drum.

14. The system of claim 1, wherein the underside of the vehicle comprises an arm extending to the at least one pick disposed on the drum and adapted to dislodge loose aggregate from the pick.

15. The system of claim 1, wherein a boundary of the milling chamber comprises a plurality of nozzles offset relative to one another.

16. The system of claim 1, wherein a boundary of the milling chamber comprises a brush with the bristles in contact with the at least one pick on the drum.

17. The system of claim 1, wherein the boundary of the milling chamber comprises at least one retractable protrusion adapted to loosen aggregate on the drum that extends to and from the drum.

18. The system of claim 1, wherein the conveyor belt comprises a vacuum device adapted to remove loose aggregate from the drum and place the loose aggregate onto the conveyor belt.

19. The system of claim 1, wherein the reservoir comprises fluid, air, gas, water, liquid, carbon dioxide, or a combination thereof.

20. A method for removing a layer of a paved surface, comprising the steps of:

providing a vehicle adapted to traverse a paved surface in a selected direction;

providing a milling drum with an axle connected to the vehicle, the drum being adapted to rotate around the axle;

providing at least one nozzle in communication with a reservoir through a pathway and being positioned on the underside of the vehicle and near the top left quadrant of the drum opposite the surface;

rotating the drum against a paved surface such that a layer of the paved surface is loosened; and cleaning an exposed layer of the paved surface by directing a portion of the loosened aggregate in a generally forward direction by ejecting a fluid out of the at least one nozzle onto the conveyor belt.

* * * * *